US006787694B1

(12) United States Patent
Vexler et al.

(10) Patent No.: US 6,787,694 B1
(45) Date of Patent: Sep. 7, 2004

(54) TWISTED PAIR CABLE WITH DUAL LAYER INSULATION HAVING IMPROVED TRANSMISSION CHARACTERISTICS

(75) Inventors: Gavriel Vexler, Westmount (CA); Gilles Gagnon, Lorraine (CA)

(73) Assignee: Cable Design Technologies, Inc., St. Louis, MO (US)

( * ) Notice: Subject to any disclaimer, the term of this patent is extended or adjusted under 35 U.S.C. 154(b) by 0 days.

(21) Appl. No.: 09/585,072

(22) Filed: Jun. 1, 2000

(51) Int. Cl.[7] ..... H01B 7/00; H01B 7/34

(52) U.S. Cl. ..... 174/27; 174/36; 174/113 R; 174/120 R

(58) Field of Search ..... 174/27, 110 R, 174/113 R, 120 R, 36, 32, 33, 34, 120 AR, 120 SR; 57/237, 906

(56) References Cited

U.S. PATENT DOCUMENTS

| | | | | |
|---|---|---|---|---|
| 2,953,551 A | | 9/1960 | White | |
| 3,424,631 A | | 1/1969 | Peacock | |
| 3,553,348 A | | 1/1971 | Betts | |
| 3,584,132 A | * | 6/1971 | Brauns et al. | 174/34 |
| 3,802,913 A | | 4/1974 | Mackenzie, Jr. | |
| 3,803,339 A | | 4/1974 | Speekman | |
| 3,843,831 A | | 10/1974 | Hutchison et al. | |
| 3,922,442 A | | 11/1975 | North et al. | |
| 4,018,983 A | | 4/1977 | Pedlow | |
| 4,020,214 A | | 4/1977 | MacKenzie, Jr. | |
| 4,150,249 A | | 4/1979 | Pedersen | |
| 4,238,638 A | | 12/1980 | Cretney et al. | |

(List continued on next page.)

FOREIGN PATENT DOCUMENTS

| | | |
|---|---|---|
| DE | 25 18 621 | 10/1976 |
| GB | 1175850 | 12/1969 |
| GB | 20 50041 | 12/1980 |

OTHER PUBLICATIONS

Breazeale, Almut F. "Wire and Cable Fire Performance as Determined by a Cone Calorimeter," presented at the 37th International Wire and Cable Symposium, Reno, Nevada, Nov. 15–17, 1988.

Beyreis, J.R., J.W. Skjordahl, S. Kaufman and M. M. Yocum. "A Test Method for Measuring and Classifying the Flame Spreading and Smoke Generating Characteristics of Communications Cable." [Publication Unknown], (1976), pp. 291–295.

Delucia, Michael A. "Highly Fire–Retardant Navy Shipboard Cables." [Publication Unknown], (1976), pp. 281–290.

E.I. Dupont De Nemours & Co.(Inc.) "Fire Alarm Cable of "TEFLON®" Fluorocarbon Resins," product information of E. I. Du Pont de Nemours.& Co. (Inc.), Plastic Products & Resin Department, Wilmington, Delaware 19898, May 9, 1977.

E.I. Dupont De Nemours & Co.(Inc.) "Characteristics and Uses of KEVLAR® ARAMID High Modulus Organic Fiber" DuPont Technical Information Bulletin No. K–5, (Sep., 1981) pp. 1–13.

E.I. Dupont De Nemours & Co.(Inc.) "Properties of NOMEX® Aramid Filament Yarns," DuPont Technical Information, Bulletin NX–17, (Dec., 1981).

(List continued on next page.)

*Primary Examiner*—William H. Mayo, III
(74) *Attorney, Agent, or Firm*—Lowrie, Lando & Anastasi, LLP

(57) ABSTRACT

The present invention includes a twisted pair cable having a plurality of pairs, wherein each has two conductors. Each of the conductors is covered with an inner layer insulator and an outer layer insulator, wherein the positioning of the conductors within the inner and outer insulators is eccentric with respect to the inner and outer insulators. This invention also includes a method of making a cable of the same configuration.

14 Claims, 3 Drawing Sheets

U.S. PATENT DOCUMENTS

| | | | | | |
|---|---|---|---|---|---|
| 4,243,579 | A | | 1/1981 | Keogh | |
| 4,260,661 | A | | 4/1981 | Walters et al. | |
| 4,280,225 | A | | 7/1981 | Willis | |
| 4,349,605 | A | | 9/1982 | Biggs et al. | |
| 4,370,076 | A | | 1/1983 | Sullivan et al. | |
| 4,401,845 | A | | 8/1983 | Odhner et al. | |
| 4,412,094 | A | | 10/1983 | Dougherty et al. | |
| 4,419,157 | A | | 12/1983 | Ferrentino | |
| 4,456,654 | A | | 6/1984 | Kotian | |
| 4,481,379 | A | * | 11/1984 | Bolick, Jr. et al. | 174/36 |
| 4,500,748 | A | | 2/1985 | Klein | |
| 4,562,302 | A | | 12/1985 | Checkland et al. | |
| 4,595,793 | A | | 6/1986 | Arroyo et al. | |
| 5,015,800 | A | | 5/1991 | Vaupotic et al. | 174/34 |
| 5,162,609 | A | * | 11/1992 | Adriaenssens et al. | 174/34 |
| 5,563,377 | A | * | 10/1996 | Arpin et al. | 174/121 A |
| 5,606,151 | A | | 2/1997 | Siekierka et al. | 174/113 R |
| 5,767,441 | A | * | 6/1998 | Brorein et al. | 174/27 |
| 5,770,819 | A | | 6/1998 | Mehan | 174/110 PM |
| 5,841,072 | A | * | 11/1998 | Gagnon | 174/110 F |
| 6,153,826 | A | * | 11/2000 | Kenny et al. | 174/27 |
| 6,167,687 | B1 | * | 1/2001 | Thompson | 57/58.49 |
| 6,211,467 | B1 | * | 4/2001 | Berelsman et al. | 174/113 R |
| 6,272,828 | B1 | * | 8/2001 | Walling et al. | 57/58.49 |

OTHER PUBLICATIONS

Hagman et al., "Ethylene/Acrylic Elastomers," E.I. DuPont De Nemours & Co., Bulletin EA–000.2, Reprinted from Rubber Age, May 1976.

Fasig, E.W., Jr., D.B. Allen and J.C. Reed. "Performanace of Fluoropolymer Wire and Cable Insulation in Large Scale Test for Flammability, Smoke, Corrosive Off–Gases and Circuit Integrity," [Publication Unknown], (1977), pp. 239–248.

Fasig, E.W., Jr., D.B. Allen and J.C. Reed. "Performanace of Fluoropolymer Wire and Cable Insulation in Large Scale Test for Flammability, Smoke, Corrosive Off–Gases and Circuit Integrity," IWCS, (1977), pp. 1–21.

Gouldson, E.J., G.R. Woolerton and J.A. Checkland. "Fire Hazard Evaluation of Cables & Materials, " [Publication Unknown], (1975), pp. 26–36.

Harbort, Hans. "New Flame Retardant Halogen–Free Cables for Nuclear Power Plants." Conference: Cheery Hill, N.J., U.S.A., Proceedings of 29th International Wire & Cable Symposium (IWCS), (Nov. 1980), pp. 263–267.

Kaufman, S. and C.A. Landreth. "Development of Improved Flame Resistant Interior Wiring Cables," [Publication Unknown], (1975), pp. 9–14.

Kaufman, S., and R.S. Dedier. "A PVC Jacket Compound with Improved Flame Retardancy and Superior Physical Properties,"[Publication Unknown], (1974), pp. 281–289.

Kingsbury, E.R., A.C. Bruhin and A.F. WU. "A Flame Resistant Power and Control Cable Insulation for Modern Electrical Applications,"[Publication Unknown], (1979), pp. 299–304.

Leuchs, Ottmar, Dr. "A New Self–Extinguishing Hydrogen Chloride Binding PVC Jacketing Compound for Cables," [Publication Unknown], (1970), pp. 239–255.

Lovett, Robert, and Robert E. Stabler. "What They're Saying About TEFLON® Fluorocarbon Resins." *Wire and Wire Products*, (Oct. 1958).

Matsubara, H., C. Matsunaga, A. Inoue and N. Yasuda. "Development of New Fire–Proof Wire and Cable," [Publication Unknown], (1975), pp. 15–25.

Matsuo. J., M. Hanai, Y. Yamamoto, T. Sakurai, and I. Nishikawa. "Development of Flame Resistant Cables for Nuclear Power Plant and Their Qualification Test Results," Publication Unknown, pp. 216–227, 1977.

Mayer, H.A., and G. Hög. "New Generation of Nonhalogenated, Flame Retardant Compounds and Cables." IWCS, (Nov. 1980), pp. 253–262.

Penwalt Corporation. "Kynar® for Electrical/Electronic Applications Now/UL Classified for Plenum Cable Use," Product information of Penwalt Corporation, Plastics Department, Three Parkway, Philadelphia, PA 19102.

Przybyla, L.J., E.J. Coffey, S. Kaufman, M.M. Yocum, J.C. Reed and D.B. Allen. "Low Smoke and Flame Spread Cables," [Publication Unknown], (1979), pp. 281–291.

Rodriguez, J.L., and J. Cobo. "The Effect of Silane Coupling Agents on Filed PVC Jacketing Formulation Properties," [Publication Unknown], (1978), pp. 313–320.

W. S. Libbey Co. Technical Data Sheet on NOMEX thermal insulation products, W. S. Libbey Co., One Mill Street, Lewiston, Maine 04240, Apr. 6, 1982.

Wadehra, Inderjit L. "The Performance of Polyvinyl Chloride Communication Cables in a Modified Steiner Tunnel Test, " [Publication Unknown], pp. 312–318.

Yamamoto, T., Y. Takahashi and K. Nakano. "Development of Flame–Resistant Cables for Instrumentation and Communication," [Publication Unknown], (1979), pp. 292–298.

Underwriters Laboratories Inc., "Standard for Test Method for Fire and Smoke Characteristics of Cables Used in Air–Handling Spaces," UL, 333 11/81–4/82.

Weiss, Joseph. "Use of coaxial plenum cable for high speed data transmission,"*Electronic Packaging and Production*, vol. 21, Part 6, Jun., 1981, pp. 145–149.

Hickey, Jack. "Wire and Cable—what's happening?", *Instruments and Control Systems*, vol. 53, Part 5, May, 1980, pp. 39–42.

"Plenum Cable of 'Teflon' Without Conduit Meets Safety Standards, Provides Cost Savings to Modern Buildings," *Plast.Bldg.Constr.*, vol. 6, No. 10, 1983, pp. 6–8.

Kaufman, Stanley. "PVC in Commincations Cable," *Journal of Vinyl Technology*, Sep. 1985, vol. 7, No. 3, pp. 107–111.

Cohn, Jerome I. "Development and Application Notes on "Thin–Wall" Teflon Insulated Wire and Cable," presented at Seventh Annual Wire and Cable Symposium, Ashbury Park, New Jersey, Dec. 2–4, 1958. pp. 1–12.

* cited by examiner

TWISTED PAIR CABLE WITH DUAL LAYER INSULATION HAVING IMPROVED TRANSMISSION CHARACTERISTICS

FIELD OF THE INVENTION

The present invention relates to twisted pair cables which can be used in high frequency applications.

DESCRIPTION OF THE PRIOR ART

Twisted pair cables have become the physical media of choice for local area networks in the last 10 years. The current EIA/TIA 568 A Category 5 specifications (and the associated addenda) for these cables call for performance up to a frequency of 100 MHz.

Installed transmission systems were, until recently, operating only at 10 Mbit/s and did not use all the available bandwidth offered by cables meeting the existing specifications. In fact, the Ethernet protocol used in over 70% of the installed networks, employs only two pairs of the available four and uses half-duplex transmission, i.e. one pair is transmitting while the other is receiving.

In the last five years, new transmission technology, operating at 100 Mbit/s has been rapidly expanding in the marketplace. At the same time, improved cables with transmission characteristics exceeding the current EIA/TIA 568 A Category 5 specifications (and the associated addenda) were also developed. Despite the assurance of performance promised by the existing specifications, cable manufacturers have developed cables with improved performance as an insurance policy for future applications. In addition, process variation during the manufacture of the cable and further handling during installation were causing deterioration in cable performance, thus the requirement of transmission characteristics that exceeded the current specifications.

More recently, new data transmission technology has indeed pushed the speed limit to 1 Gigabit/s and higher. This transmission technology and some of the existing 100 Mbit/s transmission technologies, when applied to twisted pair cables, require the use of all four pairs in a cable in duplex operation (bi-directional transmission). These new protocols have increased noticeably the transmission performance requirements of the twisted pair wire cables beyond the EIA/TIA 568 A Category 5 specifications (and the associated addenda).

In the first place, the delay skew or the differential in the signal velocity amongst the 4 pairs has to be minimal in order to enable fast de-scrambling of the four bit signals into a coherent bit sequence at the receiving end.

Additional capabilities for bi-directional transmission are also required in order to obtain the maximum bandwidth available on a 4-pair twisted cable. This last requirement introduces the possibility of multi-pair power sum near end, equal level far end and multi-pair power sum equal level far end cross-walk, as well as the increased possibility that return loss (due to impedance irregularities) will impair transmission. Twisted pair cables have to be designed with low and uniform near and far end cross-talk and, consequently, low power sum cross-talk, equal level (less the attenuation) far end and power sum equal level far end cross-talk.

Recent Category 5E addenda to the EIA/TIA 568 A specifications has taken into account these new requirements. However, there is no consensus yet on the specifications for a twisted pair cable that will meet the requirements for beyond 1 Gbit/s transmission. The first draft C1 for such a new specification introduces the new Category 6 cabling system and has its ISO counterpart draft specification (ISO/IEC SC25 WG3 Proposal).

There are already in the marketplace several cable designs that claim to meet and even exceed the proposed Category 6 specifications. The first cable design that claims gigabit capability was developed by Belden Wire & Cable Company (U.S. Pat. No. 5,606,151 to Siekierka et al.) and uses the joining of the two insulated conductors in a pair by means of an adhesive or by co-extruding the two insulated conductors with a very small joining web. This device is meant to mainly improve the longitudinal impedance uniformity to less than +/−15 ohm and, as a result, to minimize return loss impairments of the resulting 4 pair twisted cable. The claimed reason for the observed reduction in impedance irregularities is explained by the fact that cyclical and random irregularities that can be imparted in the twisted pair during the twisting process due to differences in twisting tension are eliminated when the bonded pairs are twisted together. It is also claimed that the cable resists deformation during process handling and installation.

In addition, the cable described in this patent uses a crescent cable structure whereby each pair is secured in a single tube-like slot. The manufacturer claims improved near end and far end cross-talk performance for this design. However, this structure is exceedingly difficult to manufacture as each tube-like slot cannot have even the smallest variations in diameter without a marked deterioration of the electrical characteristics. When cables are stacked together in installations, there are also greater chances for inter cable cross-talk impairments due to the proximity of pairs with same twisting lays separated only by the jacket thickness. The bonded pairs are also difficult to strip and install. This design does not impart any additional advantage as far as the reduction of cross-talk impairments is concerned. It also does not eliminate impedance variations that can be caused by off centre, oval or otherwise irregularly shaped insulation.

U.S. Pat. No. 5,767,441 to Brorein et al. claims to eliminate such impedance variations through the pre-twisting of insulated conductors prior to twisting the insulated conductors in double twist machines or by twisting the pairs through a single twist process. This process has unleashed a flood of equipment designed to impart back-twist capabilities for manufacturers of high performance cables. In addition, this patent discloses a flat cable structure, similar to the cable described in the previous patent. The manufacturing process of this cable is also prone to cause small variations in the pair slot dimensions, thus compromising the transmission performance of the resulting 4-pair cable. In addition, the structure of these flat cable designs may pose additional transmission problems, due to inter-cable cross-talk or "alien cross-talk" that cannot be cancelled electronically through DSP filtering.

Another solution to gigabit performance requirements has been put forth by the proponents of cables with central members whereby the twisted pairs are separated by means of a longitudinal central member (CommScope Isolator™ design, Hitachi Manchester's HI-NET™ and other designs). This design affords the greatest reduction of cross-talk impairments but does not eliminate impedance irregularities. The insertion of a central member with the four pairs symmetrically disposed around it is difficult to achieve and slows down the manufacturing processes. In addition, the cable diameter is increased by at least 20%. The overall cost of the cable is also substantially increased due to the additional cost of the center member and higher jacketing material costs.

SUMMARY OF THE INVENTION

It is the object of this invention to eliminate many of the difficulties inherent in the cables of the prior art while substantially reducing both cross-talk impairments and impedance irregularities in a cost competitive manner respectful of the EIA/TIA specifications.

In accordance with the invention, this object is achieved with a twisted pair cable comprising a plurality of pairs, each of said pairs comprising two conductors, each of said conductors is covered with an inner layer insulator and an outer layer insulator, said conductors being eccentric with respect to the overall insulation of said inner and outer layer insulator.

The present invention also concerns a method for making the same.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

As mentioned above, the present invention concerns a cable which eliminates many of the difficulties inherent in the cables of the prior art while substantially reducing both cross-talk impairments and impedance irregularities in a cost competitive manner respectful of the EIA/TIA specifications discussed above.

In accordance with a broad aspect of the invention, the cable of the present invention comprises a plurality of pairs. Each pair comprises two conductors 11, each conductor comprising an inner layer insulator 13 and an outer layer insulator 15. The conductors 11 are eccentric with respect to the overall insulation dimension, as clearly shown in FIG. 4*a*. Consequently, referring now to FIG. 4*a*, the conductors 11 are separated by a distance S1 which is smaller than the separators S2 of conductors 11 in adjacent pairs. Stated another way, the conductors 11 are asymmetric, such that the conductors 11 are closer to each other in a pair than to conductors 11 in adjacent pairs in contact at the outer surface opposite the conductors 11.

Figure 1:
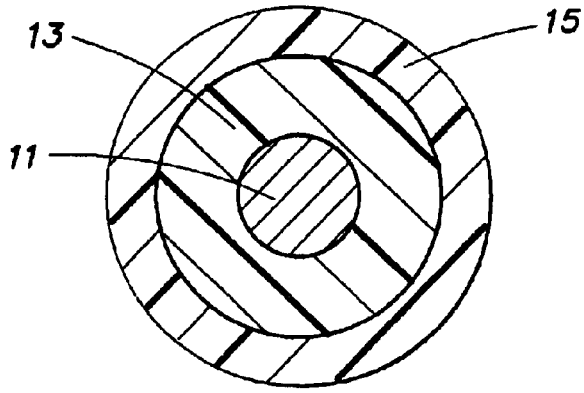
FIG. 1 is a cross-sectional representation of a conductor of a twisted pair cable according to a preferred embodiment of the present invention.

In a preferred aspect of the invention, each conductor 11 is provided with an inner layer insulator 13, and an outer layer insulation 15. Preferably, one of the layers has a first modulus of elasticity, and the other layer has a second modulus of elasticity, where the first modulus is greater than the second modulus. Consequently, in order to obtain the cable of the present invention, a twisted pair cable is provided comprising of conductors insulated with a thick inner layer and a thinner outer layer (see FIG. 1). The inner dielectric layer 13 can be chosen from a group of extrudable polymers that have a modulus of elasticity exceeding 64 Kpsi at room temperature, a dielectric constant lower than 2.5 and a loss factor lower than 0.0003 when tested from 1 MHz to 1 GHz. The outer dielectric layer 15 is chosen from another group of extrudable polymers, also called thermoplastic elastomers, that have a modulus of elasticity below 35 Kpsi at room temperature and similar but not necessarily better electrical characteristics. (See FIG. 1)

In another embodiment of this disclosure, a thinner inner dielectric layer 13 is chosen from the group of elastomers, while the relatively high elastic modulus polymers are applied as a thicker outer layer 15. (See FIG. 2*a*)

In a third embodiment of this disclosure, a inner dielectric 13 is chosen from the group of elastomers the relatively high elastic modulus polymers is applied as an intermediary layer 15 and an outer layer 17 is chosen from the same group of extrudable elastomers, as the inner dielectric 13. (See FIG. 2*b*)

One major mechanical characteristics of elastomers is their capacity to undergo relatively high strain in the elastic domain under relatively low mechanical stress and achieve complete recovery following the release of the stress. Conversely, for high modulus materials, there is a small strain domain where the material behaves elastically under relatively high stress; beyond that domain, the high modulus materials deform permanently or plastically.

The present invention takes advantage of the presence of an elastomer as the outer or the inner layer of the insulated conductor, and possibly in both outer and inner layer of a three layered insulation, to create, during the process of pair twisting and pair assembly, a structure that is mechanically pre-stressed and will resist further deformations. The resulting cable will have reduced cross-talk impairments and impedance irregularities and will maintain its characteristics following packaging and installation.

Figure 3:
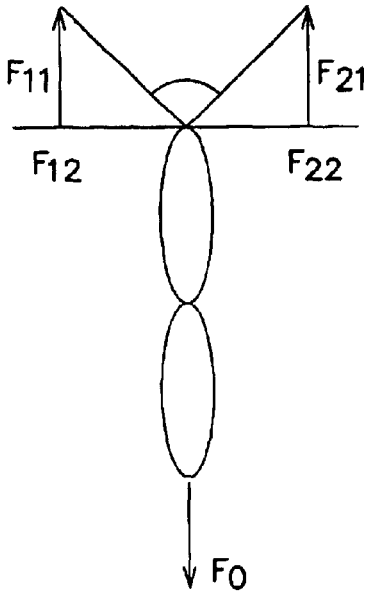
FIG. 3 is a schematic representation of the stretching and the twisting of two conductors to form twisted pair cable according to a preferred embodiment of the present invention.

During the twisting action, when the individual insulated conductors come into contact, the elastomer outer layer is constrained into the high modulus inner layer following the overall ductile deformation of the copper conductors. As better shown in FIG. 3, the conductors 11 provided with the insulations are subjected to longitudinal forces F11 and F21, and lateral forces F12 and F22 at the twisting apparatus pay-offs.

While the perpendicular tensions F12, F22 resultant during the process are too small to effect a significant elastic deformation of the high modulus layer, the elastomer layer can be readily deformed to effect a permanent deformation that is still in the elastic domain following the twisting process. Thus, the twisted pair constructed as described above constitutes, within given boundaries of flexing of the twisting strand, a mechanically pre-stressed structure and will resist further deformations.

It was found that, in order to obtain the advantages disclosed in the present application, the outer or the inner thin elastomer layer thickness is preferably at least 15% of the overall insulation thickness. This is also the case when the twisted pair cable includes an inner and the outer elastomer layer and a middle extrudable polymer layer. Consequently, the combined thickness of the inner and outer elastomer layers is preferably at least 15% of overall insulation thickness. The intensity of the forces F11, F12, F21, F22 in play on the individual conductors and the twisted pair during the manufacturing process are also important in obtaining the disclosed advantages. It should be noted that the series of forces F11 and F21 is equivalent to the resulting force F0.

Figure 4A:
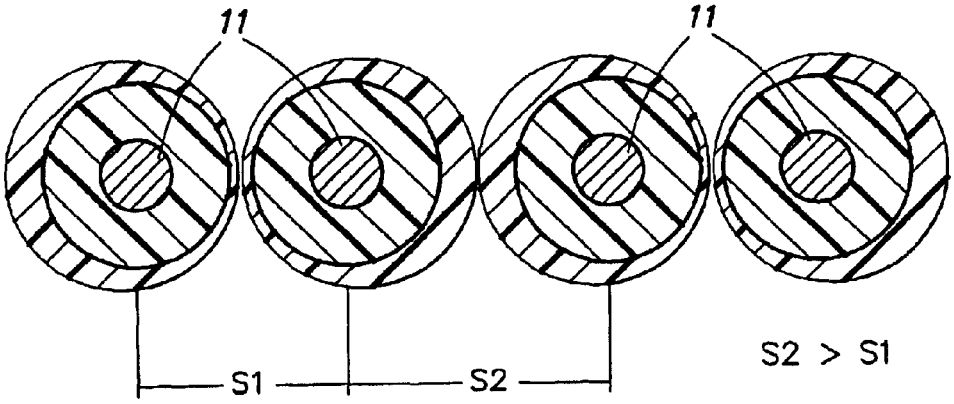
FIG. 4*a* is a schematic representation of the eccentricity of the conductors with respect to the insulation according to a preferred embodiment of the present invention.
Figure 4B:
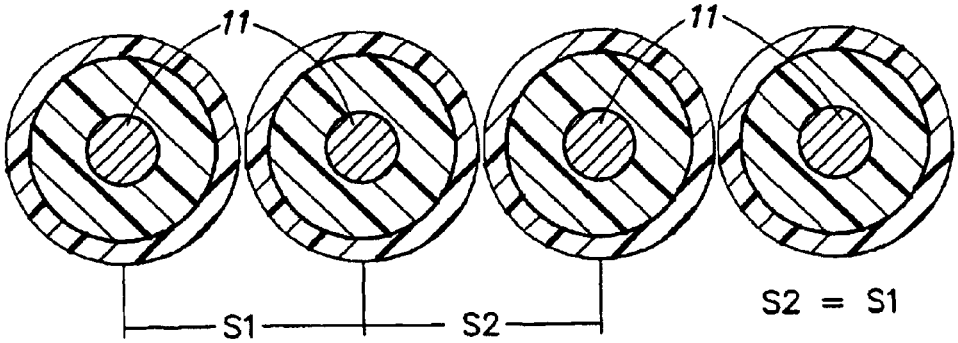
FIG. 4b (PRIOR ART)
FIG. 4*b* is a schematic representation of a twisted pair cable according to the prior art.

The structure of the resulting twisted pair, as disclosed above, is asymmetric i.e.: the separation $S_1$ between the two conductors in a pair is smaller than the separation $S_2$ between the two conductors of an adjacent pair (FIG. 4*a*). In the known art, twisted pairs of perfectly centred insulated conductors have a symmetrical structure whereby the separation $S_1$ between the two conductors in a pair is equal to the separation $S_2$ between the two conductors of an adjacent pair (FIG. 4*b*).

Figure 2A:
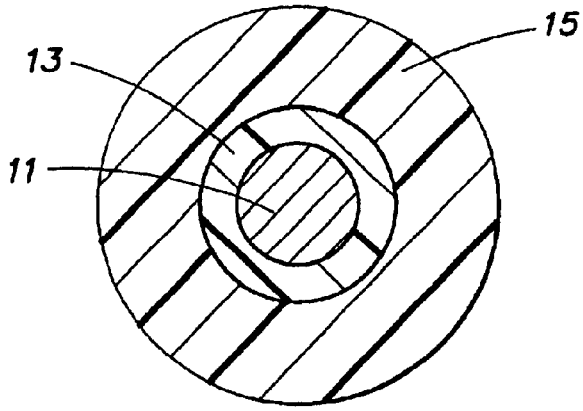
FIG. 2*a* is a cross-sectional representation of a conductor of a twisted pair cable according to another preferred embodiment of the present invention.
Figure 2B:
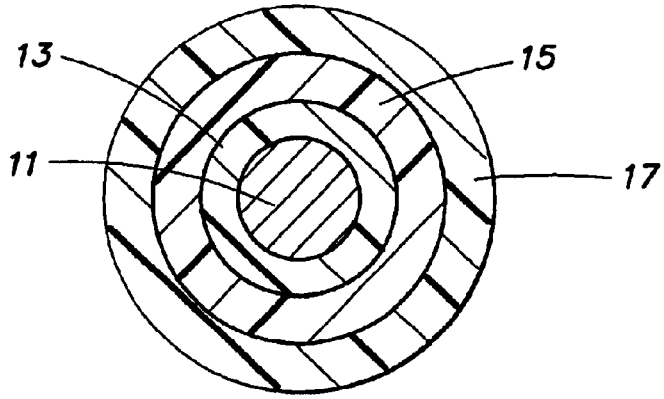
FIG. 2*b* is a cross-sectional representation of a conductor of a twisted pair cable according to yet another preferred embodiment of the present invention.
Figure 5A:
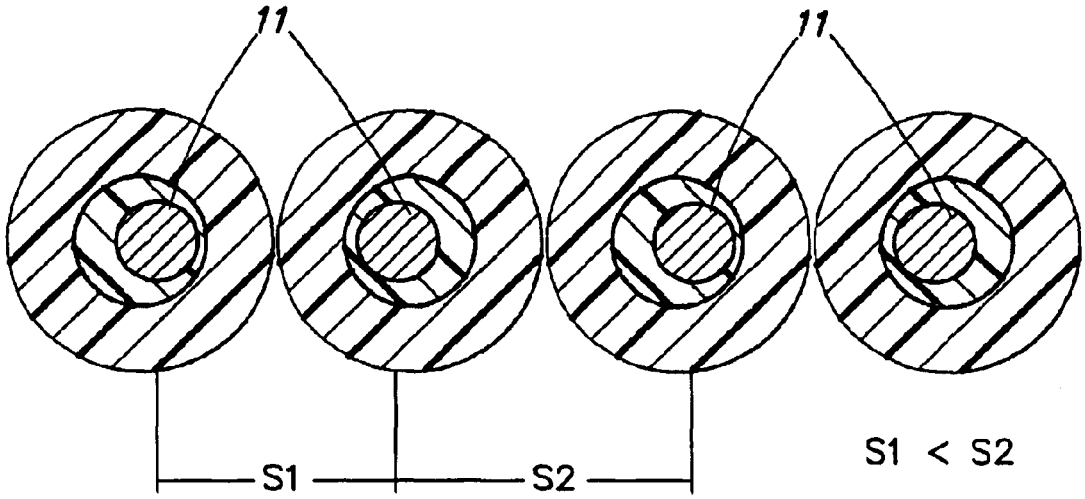
FIG. 5*a* is a schematic representation of the eccentricity of the conductors with respect to the insulation according to a second preferred embodiment of the present invention.
Figure 5B:
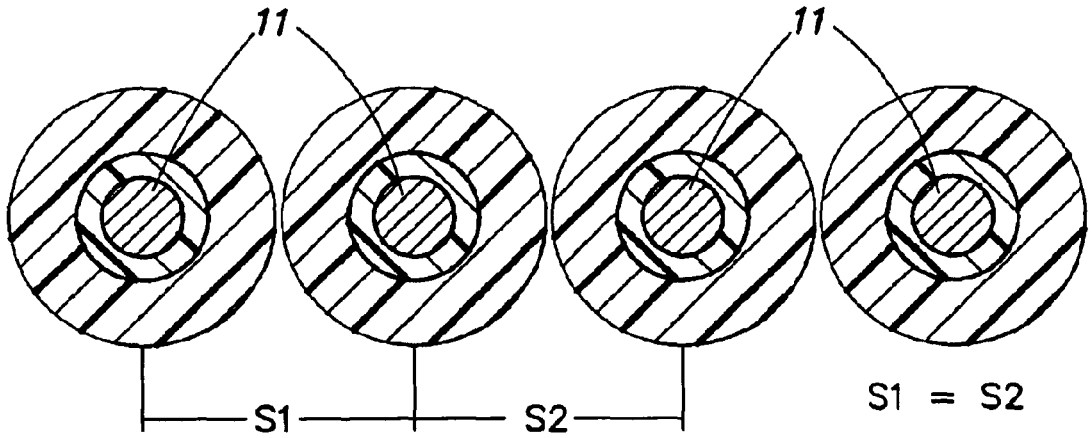
FIG. 5b (PRIOR ART)
FIG. 5*b* is a schematic representation of a twisted pair cable according to the prior art.

Alternatively, the embodiment of FIG. 2*a* would also result in an asymmetric structure i.e.: the separation $S_1$ between the two conductors in a pair is smaller than the separation $S_2$ between the two conductors of an adjacent pair (FIG. 5*a*). In the known art, twisted pairs of perfectly centred insulated conductors have a symmetrical structure whereby the separation $S_1$ between the two conductors in a pair is equal to the separation $S_2$ between the two conductors of an adjacent pair (FIG. 5*b*).

The immediate advantage of such a pair structure is that, while the impedance of the proposed cable is equilvalent to a cable of identical conductor separation, the separation between the pairs of the proposed cable exceed the norm in a cable with symmetrical pair structure. The higher separation between pairs induces tangible electrical performance improvements that result in a cable with reduced cross-talk impairments and lower signal attenuation. Both reductions contribute to a much improved signal to noise performance of the resulting cable. For example, an experimental cable with a 0.008" overall insulation thickness having a 0.003" outer elastomer layer and a 0.036" overall diameter has shown an improvement of at least 35% in the near end cross-talk (normal scale) when compared with a standard cable of same construction in a frequency range from 1 to 300 MHz.

The inherent advantages of the proposed cable are not limited to the improvement of the final cable cross-talk and attenuation characteristics. The presence of an elastomer layer in the insulated conductor constitutes a definite advantage during the subsequent processing stages of the cable. During the insulation process, the elastomer layer will cushion the unavoidable variations in tension generated during the spooling of the insulated conductor into the take-up reels. In addition, better spooling of the insulated conductor is obtained on the take-up reels. Subsequently, the twisting process is helped by the better spooling that will lower the variation in payoff speeds between the two individual insulated conductors of the pair. More importantly, the unavoidable variations in tension, caused by speed differences and irregularities in the mechanical devices during the twisting, are absorbed by the elastomer layers and limit the dimensional variations to the thickness of an elastomer layer. Consequently, the proposed cable has very stable input impedance as a function of the frequency from 0.772 to 350 MHz due to the limitation in the possible variation of the separation between the conductors $S_1$ that is limited to the elastomer layer thickness. This variation does not exceed 0.0002". Prior art (U.S. Pat. No. 5,606,151) has shown that such a variation will result in a 6 ohms impedance variation, well below the maximum +/−15 ohms specified by the EIA/TIA specifications. The impedance stability is also reflected in the fact that the return loss of the proposed cable is very low without any backtwisting of the insulated conductors. Experimental results have shown, in fact, that there is little discernible difference between backtwisted insulated conductors and non-backtwisted ones.

It was also shown that by varying the twisting tension, one can obtain the same results as above with thinner elastomer layers. This unexpected property can provide the designer with the ability to develop a cable with perfectly balanced impedance properties without varying the overall diameter of the insulated conductor.

Unexpectedly, the proposed cable has also very low delay skew i.e. the difference between the propagation speed in the four pairs is minimal, well below the required by the same C1 draft. This characteristic is reflected in the fact that the pairs signal attenuation curves are almost identical. As mentioned in the background of the invention, a low delay skew is essential for the operation of bi-directional transmission protocols.

The overall transmission characteristics of the proposed cable are within the requirements of the latest draft C1 of the proposed Category 6 addendum to the TIA/EIA 568 A.

The elastomer layer can also be used as a carrier for colour and flame retardant additives (but only when the elastomer layer is the outer layer). By doing so, an additional improvement in the electrical performance of the cable will be obtained at a lower cost in additives that otherwise are dispersed in the entire insulation. In a preferred embodiment, the inner layer elastomer will incorporate particles of inorganic flame retardants or other flame retardant polymer having excellent dielectric capabilities and the outer layer will be a flame retardant polymer with low dielectric constant and loss factor.

In addition, the elastomer layer can be foamed in order to reduce the signal attenuation of the individual pair and of the resulting 4 pair cable. Foaming will also increase the compressibility of elastomer layer, thus increasing the asymmetry of the twisted pairs. It was disclosed above that this feature of the present disclosure contributes to the reduction in cross-talk impairments.

An additional embodiment of the disclosure is a foam-skin insulated conductor that is composed of a first foamed layer and a second elastomer layer with a very low elastic—15 Kpsi and lower—modulus. The mechanical fragility of traditional foam-skin insulation designs is well known. In the proposed design, the elastomer skin layer acts as a cushion that mechanically protects the fragile foam layer during the subsequent process stages.

The use of the above asymmetrical pair design in the STP (Shielded Twisted Pair) and ScTP (screened twisted pair) cable is an additional advantageous application of the concept. An asymmetric pair surrounded by a metallic shielded film will have lower attenuation, and better impedance stability that a standard pair structure. In recent STP cable designs, foam is the recommended insulation. Thus, the elastomer top layer will be helpful in protecting the foamed layer as disclosed above.

Another potential application of the asymmetric pair concept is in the area of multi-pair outside plant cables. The widespread penetration of the Internet has raised the bandwidth requirements of the existing telephone network. Solutions for the trunk section of the network are available in the form of the fibre and or fibre/coax technology. The distribution to single residences and small offices is more problematic given the enormous cost involved in the complete conversion to fibre. Upgrading the capability of outside plant copper based drop wires is a very attractive cost effective solution. Drop wires incorporating the asymmetric pair concept will considerably increase the bandwidth of the resulting multi-pair outside plant cables, especially the ones incorporating a metallic screen.

It should be understood that one important aspect of the invention is the use of two different insulator layers, one of which can undergo a permanent deformation under predetermined conditions, while the other layer does not undergo a permanent deformation. Although preferred materials have been described herein, it should be apparent to a person skilled in the art that other materials can be used and which will meet the object of the invention.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A twisted pair cable comprising a plurality of pairs, each of said pairs comprising:

two assemblies, a first assembly comprising:

a first conductor, said first conductor being closer to a second conductor of a second assembly then to an outer surface opposite said conductors;

an inner insulator surrounding the first conductor;

an outer insulator surrounding the inner insulator;

an inner edge of the first assembly defined by a surface of the first assembly closest to a second assembly in the same pair; and an outer edge of the first assembly defined by a surface of the first assembly farthest from the second assembly in the same pair, the outer edge of the first assembly being farther from the first conductor than the inner edge of the first assembly over the length of the pair.

2. A twisted pair cable according to claim 1, wherein said inner insulator is an extrudable polymer, and wherein said outer insulator is an extrudable elastomer.

3. A twisted pair cable according to claim 2, wherein said extrudable polymer has a modulus of elasticity greater than 64 Kpsi at room temperature, a dielectric constant lower than 2.5 and a loss factor lower than 0.0003 between 1 MHz and 1 GHz; and wherein said elastomer has a modulus of elasticity lower than 35 Kpsi at room temperature.

4. A twisted pair cable according to claim 2, wherein said extrudable elastomer further includes a carrier for color and flame retardant additives.

5. A twisted pair cable according to claim 2, wherein said elastomer is foamed.

6. A twisted pair cable according to claim 2, wherein said extrudable polymer is foamed, and wherein said elastomer has a modulus of elasticity lower than 35 Kpsi at room temperature.

7. A twisted pair cable according to claim 2, wherein said elastomer thickness is greater than 15% of the overall insulation thickness.

8. A twisted pair cable according to claim 1, wherein said inner insulator is an extrudable elastomer and wherein said outer insulator is an extrudable polymer.

9. A twisted pair cable according to claim 8, wherein said extrudable polymer has a modulus of elasticity greater than 64 Kpsi at room temperature, a dielectric constant lower than 2.5 and a loss factor lower than 0.0003 between 1 MHz and 1 GHz; and wherein said elastomer has a modulus of elasticity lower than 35 Kpsi at room temperature.

10. A twisted pair cable according to claim 8, wherein said elastomer and said extrudable polymer are foamed.

11. A twisted pair cable according to claim 1, wherein the first assembly further comprises a middle insulator, said inner and outer insulators being extrudable elastomers and wherein said middle insulator is an extrudable polymer.

12. A twisted pair cable comprising a plurality of pairs, each of said pairs comprising:

two conductor assemblies, a first assembly comprising:

a first conductor, said first conductor being closer to a second conductor of a second assembly than to an outer surface opposite said conductors over the length of the pair;

at least one layer of insulator surrounding the first conductor;

an inner edge of the first assembly defined by a surface of the first assembly closest to a second conductor assembly in the same pair; and an outer edge of the first assembly defined by a surface of the first assembly farthest from the second conductor assembly in the same pair.

13. A method for making a twisted pair cable comprising:

(a) providing a first and a second conductor, each of said first and said second conductor being insulated with an inner insulator and an outer insulator, one of said inner and outer insulator having a modulus of elasticity lower than 35 Kpsi at room temperature, the other of said inner and outer insulator having a modulus of elasticity greater than 64 Kpsi;

(b) stretching said first and second conductor at a sufficient angle and by an amount sufficient to effect a permanent deformation of the insulator having the lower modulus of elasticity, but not enough to effect a permanent deformation of the insulator having the higher modulus of elasticity; and (c) twisting said first and second conductors together; and (d) manufacturing a cable with a plurality of said pairs.

14. A twisted pair cable comprising a plurality of pairs, each of said pairs comprising:

two assemblies, a first assembly comprising:

a first conductor;

an inner insulator surrounding the first conductor;

an outer insulator surrounding the inner insulator;

an inner edge of the first assembly defined by a surface of the first assembly closest to a second assembly in the same pair; and an outer edge of the first assembly defined by a surface of the first assembly farthest from the second assembly in the same pair, the outer edge of the first assembly being farther from the first conductor than the inner edge of the first assembly over the length of the pair; and a second assembly comprising:

a second conductor;

an inner insulator surrounding the second conductor;

an outer insulator surrounding the inner insulator;

an inner edge of the second assembly defined by a surface of the second assembly closest to the first assembly in the same pair; and an outer edge of the second assembly defined by a surface of the second assembly farthest from the first assembly in the same pair, the outer edge of the second assembly being farther from the second conductor than the inner edge of the second assembly over the length of the pair.

* * * * *

UNITED STATES PATENT AND TRADEMARK OFFICE

CERTIFICATE OF CORRECTION

PATENT NO. : 6,787,694 B1
DATED : September 7, 2004
INVENTOR(S) : Gavriel Vexler et al.

It is certified that error appears in the above-identified patent and that said Letters Patent is hereby corrected as shown below:

Column 1,
Line 57, “cross-walk” should read -- cross-talk --.

Column 4,
Line 31, “characteristics” should read -- characteristic --.

Column 5,
Line 32, “equilvalent” should read -- equivalent --
Line 34, “exceed” should read -- exceeds --.

Column 6,
Line 17, “below the” should read -- below that --.
Line 55, “that” should read -- than --.

Signed and Sealed this

Twenty-fifth Day of January, 2005

JON W. DUDAS
*Director of the United States Patent and Trademark Office*